US008950410B2

(12) United States Patent
Park

(10) Patent No.: US 8,950,410 B2
(45) Date of Patent: Feb. 10, 2015

(54) COMB

(75) Inventor: Young-soo Park, Tokyo (JP)

(73) Assignee: PARK WAY Co. Ltd., Tokyo (JP)

( * ) Notice: Subject to any disclaimer, the term of this patent is extended or adjusted under 35 U.S.C. 154(b) by 0 days.

(21) Appl. No.: 13/001,007

(22) PCT Filed: Jun. 24, 2008

(86) PCT No.: PCT/JP2008/061455

§ 371 (c)(1),
(2), (4) Date: Dec. 22, 2010

(87) PCT Pub. No.: WO2009/157056

PCT Pub. Date: Dec. 30, 2009

(65) Prior Publication Data

US 2011/0108048 A1 May 12, 2011

(51) Int. Cl.

| | |
|---|---|
| ***A45D 24/00*** | (2006.01) |
| ***A45D 24/14*** | (2006.01) |
| ***A45D 24/02*** | (2006.01) |
| ***A45D 24/30*** | (2006.01) |

(52) U.S. Cl.

CPC ..... *A45D 24/14* (2013.01); *A45D 24/00* (2013.01); *A45D 24/02* (2013.01); *A45D 24/30* (2013.01)

USPC ..... 132/149

(58) Field of Classification Search

USPC ..... 132/149, 110, 219, 107, 105, 106, 108, 132/112, 125, 146, 148, 150; 15/159.1, 15/143.1, 160, 142; 16/430; D28/21

See application file for complete search history.

(56) References Cited

U.S. PATENT DOCUMENTS

| | | | | | |
|---|---|---|---|---|---|
| 43,038 | A | * | 6/1864 | Noyes | 132/155 |
| 1,398,864 | A | * | 11/1921 | Kelly | 15/171 |
| D147,167 | S | * | 7/1947 | Utley | D28/21 |
| D169,808 | S | * | 6/1953 | Goldman | D28/21 |
| 5,222,272 | A | | 6/1993 | Park | |

FOREIGN PATENT DOCUMENTS

| | | |
|---|---|---|
| FR | 693989 | 11/1930 |
| JP | 57-134111 A | 8/1982 |

(Continued)

OTHER PUBLICATIONS

ISA Japanese Patent Office, International Search Report of PCT/JP2008/061455, Sep. 9, 2008, 2 pages.

(Continued)

*Primary Examiner* — Todd Manahan
*Assistant Examiner* — Brianne Kalach
(74) *Attorney, Agent, or Firm* — Alleman Hall McCoy Russell & Tuttle LLP

(57) ABSTRACT

A comb has a function for preventing slippage occurring when the comb is gripped, and allowing a user to remove a liquid adhered to the fingertips promptly. Further, the comb can be deformed flexibly. The comb has a concave-convex surface formed in a back face part of a comb main body, and the holes are formed in concave parts of the concave-convex surface. Curving surfaces are formed in side face parts on both sides of the comb main body, and through-holes communicating with the holes are formed in concave parts of the curving surface. When the user applies his/her fingers onto the back face part, the concave-convex surface and the holes function as a slippage preventing part. When applying the fingers onto the side face parts, the curving surface and the through-holes function as the slippage preventing part.

12 Claims, 11 Drawing Sheets

(56) References Cited

FOREIGN PATENT DOCUMENTS

| | | | |
|---|---|---|---|
| JP | 7-39569 | | 7/1995 |
| JP | 09-131215 | A | 5/1997 |
| JP | 09-140449 | A | 6/1997 |
| JP | 2584426 | | 8/1998 |
| JP | 2000166635 | A | 6/2000 |
| JP | 2002-101943 | | 4/2002 |
| JP | 3107399 | | 12/2004 |
| JP | 3114881 | | 9/2005 |
| JP | 2005-304720 | A | 11/2005 |
| JP | 2007-1297685 | | 4/2007 |

OTHER PUBLICATIONS

ISA European Patent Office, Search Report of EP08765799.5, Dec. 19, 2011, Netherlands, 6 pages.

State Intellectual Property Office of the P.R. of China, Office Action of Chinese Patent Application No. 200880129988.4, Mar. 26, 2012, China, 12 pages.

* cited by examiner

COMB

TECHNICAL FIELD

The present invention relates to a comb, in which a slippage preventing function, a function for removing a liquid adhered to the fingertip of a user, and the like are further improved by forming a hole and a concave-convex surface in respective parts of a comb main body, and the rigidity of the comb main body is reduced so that the user can easily curve the comb flexibly according to user's conveniences.

BACKGROUND ART

Conventionally, as combs having a function related to prevention of slippage and the like, various types of combs exist. For example, a comb according to the following Patent Document 1 is provided with two or more convex parts in side face parts of a comb main body from which comb teeth protrude to implement the slippage preventing function. A comb according to Patent Document 2 is formed with a convex part (stopping part) which provides the slippage preventing function in side face parts of a bar-shaped grip part which projects from the comb main body.

Further, the following Patent Documents 3 and 4 disclose a comb in which through-holes penetrating a comb main body are formed in the thickness direction of the comb to make the through-holes function as the slippage preventing part, and to allow a user to wipe a liquid, such as a medical fluid, moisture or the like, adhered to the user's fingertips, by edges of the through-holes. The following Patent Document 5 discloses a comb provided with the slippage preventing part which is formed by filling grooves or through-holes formed in side face parts of a comb main body, with a material having a large friction coefficient.

REFERENCE DOCUMENT(S) OF RELATED ART

Patent Document 1: Japanese Utility Model No. 3114881
Patent Document 2: Japanese Utility Model No. 3107399
Patent Document 3: JP 09-131215 A
Patent Document 4: Japanese Utility Model No. 2584426
Patent Document 5: JP 2005-304720 A

DISCLOSURE OF THE INVENTION

Problem(s) to be Solved by the Invention

Beauticians and hairdressers who are users of the combs often grip a comb in a way suitable for himself/herself, and he/she may often selectively use ways to grip the comb according to the situation of hair styling. For example, the user selectively uses an arbitrary grip where the index finger is placed onto a back face part of a comb main body (a portion opposite from where the comb teeth are provided), or a grip where fingers are placed onto a side face part of the comb main body, etc.

Among the combs disclosed in the respective Patent Documents 1 to 5 described above, a comb equipped with the function, such as the slippage preventing function, in the back face part of the comb main body does not exist. For this reason, especially for the users who adopt the way where the index finger is placed onto the back face part of the comb main body, the respective Patent Documents 1 to 5 is insufficient in the function, such as the slippage preventing function to be provided in the back face part of the combs.

In the meantime, for the user who applies the fingers onto the side face part of the comb main body, the function, such as the slippage preventing function, can be provided by the convex part disclosed in Patent Documents 1 and 2, or the through-holes disclosed in Patent Documents 3 and 4. However, if considering a realistic use situation, the user is required to pay attention to align the user's fingertips which are placed onto the side face part with the positions of the convex part disclosed in Patent Documents 1 and 2 or the through-holes disclosed in Patent Documents 3 and 4 when he/she grips the comb. Therefore, the user feels uncomfortable when he/she grips the comb. Further, when cutting hair, styling hair or the like, the beauticians and the hairdressers who are users may use the comb so as to curve it conforming to the head shape of a person who is getting hair cut or having hair styled. However, there arises a problem that the conventional combs fundamentally have a high rigidity of the comb main body and, thus, are hard to curve. Note that, generally, shapes of the combs can be classified roughly into a type where the bar-shaped grip part projects from the comb main body and a type where the projecting grip part is not provided. Thus, the users selectively use these types of combs according to the use situation.

The present invention is made in view of the above problems, and provides a comb that can implement a function, such as a slippage preventing function, even when a user grips the comb so as to place his/her index finger onto a back face part of a comb main body.

Further, the present invention provides a comb that allows a user to align his/her fingertip easily to a predetermined position that achieves the slippage preventing function, even when the user grips the comb so as to apply his/her finger onto a side face part of a comb main body.

Further, the present invention provides a comb that allows a user to easily curve the comb according to a use situation by reducing the entire rigidity of the comb while securing each of the functions described above.

Means for Solving the Problems

In order to solve the above problems, according to an aspect of the present invention, a comb is provided, which includes a comb main body and two or more comb teeth provided to the comb main body. One or more holes are formed in a back face part of the comb main body, the back face part being opposite from where the comb teeth are provided.

According to the aspect of the present invention, because the hole(s) is (are) formed in the back face part, when a user grips the comb by applying his/her index finger onto the back face part of the comb main body, the fingertip of the index finger is caught by the newly formed hole. Therefore, the hole functions as a slippage preventing part. In addition, if the fingertip is wiped off, by an edge of the hole, a liquid, such as a medical fluid, moisture or the like adhered to the index finger can also be wiped off by the newly formed hole. In addition, because the comb main body has a hollow structure by the hole, the rigidity of the comb main body is reduced, and, in connection with this, the user can easily curve the comb according to a use situation. Note that, it is preferable that the back face part has two or more holes and they are formed so as to be spaced by a predetermined interval from each other, the slippage preventing function and the like can be easily exhibited to various users having different finger lengths. Moreover, the two or more holes have a role to reduce the rigidity of the comb main body moderately.

According to another aspect of the present invention, a comb is provided, which includes a comb main body and two or more comb teeth provided to the comb main body. One or more holes are formed in a back face part of the comb main body, the back face part being opposite from where the comb teeth are provided. A curving surface having two or more concave and convex parts is formed in at least one of the side face parts on both sides of the comb main body, the side face part corresponding to a thickness direction of the comb main body.

According to the aspect of the present invention, because the curving surface having the two or more concavities and convexities is formed in the side face part of the comb main body, when a user applies his/her finger(s) onto the side face part to grip the comb, the fingertip easily conforms to the concavities and convexities of the curving surface. Therefore, even if the user does not pay attention in particular to the position of the fingertip, the slippage preventing function can be exhibited by the curving surface. Note that, if the slippage preventing function is exhibited by accommodating the user's fingertip in the concave part which is a depression of the curving surface, length of concave parts, and intervals of the concave parts and the convex parts, and the like are suitably set so that the fingertips are accommodated in the concave parts.

According to another aspect of the present invention, a comb is provided, which includes a comb main body and two or more comb teeth provided to the comb main body. A curving surface having two or more concave and convex parts is formed in at least one of side face parts on both sides of the comb main body, the side face part corresponding to a thickness direction of the comb main body. One or more holes are formed in a back face part of the comb main body, the back face part being opposite from where the comb teeth are provided. One or more through-holes penetrating the comb main body in the thickness direction and the one or more through-holes open in a concave part of the curving surface.

According to the present invention, because, in addition to the hole of the back face part, the curving surface is formed in the side face part of the comb main body, and the through-hole is formed so as to open in the concave part of the curving surface, the user's fingertip is led by the concave shape of the curve and naturally guided to the position of the through-hole. For this reason, when a user applies his/her finger onto the side face part of the comb main body to use the comb, even if the user does not pay special attention, the user's fingertip is naturally led to the through-hole of the side face part. Thus, the slippage preventing function is exhibited easily, and the liquid adhered to the fingertip can be easy wiped off. In addition, the rigidity of the comb main body against two or more directions is reduced by the two or more holes formed in different directions, such as the hole of the back face part and the through-hole penetrating in the side face part, thereby the user easily curves the comb in his/her desired direction.

Further, in the comb according to the aspects of the present invention, the one or more through-holes and the one or more holes may communicate with each other.

According to the aspects of the present invention, because the through-hole formed in the side face part of the comb main body communicates with the hole formed in the back face part, the ventilation of the holes improves. Thus, even if the user grips the comb in a state where his/her fingertip to which the liquid adhered is applied to the hole of the back face part, the fingertip touches with open air through the hole and the through-hole, thereby the wet fingertip will get dry easily. Further, when the fluid adhered to the fingertip is wiped off by the hole of the back face part, the wiped-off fluid can be discharged to the outside through the through-hole communicating with the hole. In addition, because the wiped off liquid will not remain in the hole, cleaning of the comb and the like can be performed easily. In addition, because the through-hole communicates with the hole, the rigidity of the comb main body is further reduced, and thereby the user can further easily curve the comb.

Further, in the comb according to the aspects of the present invention, a concave-convex surface having two or more concave and convex parts may be formed in the back face part of the comb main body, and the hole may open in a concave part of the concave-convex surface.

According to the aspects of the present invention, because the hole of the back face part opens in the concave part of the concave-convex surface formed in the back face part, if the user grips the comb by applying his/her index finger onto the back face part, the fingertip of the index finger is guided into the concave part of the concave-convex surface to be naturally located at the hole. As a result, the good slippage preventing function can be exhibited to the index finger by the stopping of the concave-convex surface and the catching of the hole.

Further, in the comb according to the aspects of the present invention, a base part from which a bar-shaped grip part protrudes may be formed in the comb main body, and a base part through-hole may penetrate the base part in the thickness direction of the comb main body.

According to the aspects of the present invention, in a comb of a type having a bar-shaped grip part, because the base part through-hole is formed in the base part from which the grip part protrudes, the grip part can also be curved at around its root, thereby the user can curve and deform the comb so that he/she can use it conveniently.

Effect of the Invention

According to the aspects of the present invention, because the hole is formed in the back face part, when one grips the comb by applying his/her index finger onto the back face part of the comb main body, the comb can exhibit to the index finger a function, such as the slippage prevention or the removal of the liquid adhered to the fingertip. In addition, because the rigidity of the comb main body is reduced, the comb can be curved according to the user's conveniences.

Further, according to the aspects of the present invention, because the curving surface is formed in the side face part of the comb main body, even if the user does not pay attention in particular to the position of the fingertip, the slippage preventing function can be exhibited by the curving surface.

Further, according to the aspects of the present invention, in addition to the hole of the back face part, the curving surface is formed in the side face part of the comb main body, and the through-hole is formed in the concave part of the curving surface. Thus, the fingertip gripping the comb is guided to the through-hole by the concave shape of the curving surface, and the function, such as the slippage prevention, can be easily used. In addition, forming the hole and the through-hole in different directions reduces the rigidity of the comb main body, thereby providing the easy-to-curve comb.

According to the aspects of the present invention, because the through-hole formed in the side face part of the comb main body communicates with the hole formed in the back face part, the ventilation of the hole is improved, and even in a state where the user is gripping the comb, the portion of the index finger corresponding to the hole can touch with open air. In addition, the fluid or the like wiped off from the fingertip can be prevented from being accumulated in the hole.

In addition, the rigidity of the comb main body is further reduced to make the comb easy to curve.

According to the aspects of the present invention, because the hole of the back face part is formed in the concave part of the concave-convex surface formed in the back face part, the fingertip of the index finger can be guided to the concave part of the concave-convex surface, thereby the good slippage preventing function can be exhibited to the index finger.

According to the aspects of the present invention, in a type of comb having a bar-shaped grip part, because the base part through-hole is formed in the base part from which the grip part protrudes, the grip part can also be curved at or around its root, and the user can curve the comb so that he/she can use it conveniently.

DESCRIPTION OF NUMERALS

1, 20, 40, 50, 60, and 70 Comb
2, 22, 42, 52, 62, and 72 Comb Main Body
2*a*, 22*a*, 42*a*, 52*a*, 62*a*, and 72*a* Back Face Part
2*b*, 2*c*, 22*b*, 22*c*, 42*b*, 42*c*, 62*b*, 62*c*, 72*b*, and 72*c* Side Face Part
4, 44, 54, 64, and 74 Base Part
5, 45, 55, 65, and 75 Grip Part
6, 26, and 46 Concave-convex Surface
6*a*, 26*a*, and 46*a* Concave Part
6*b*, 26*b*, and 46*b* Convex Part
7, 27, and 67 Curving Surface
7*a*, 27*a*, 67*a*, and 77*a* Concave Part
7*b*, 27*b*, 67*b*, and 77*b* Convex Part
8, 28, 48, 58, and 78 Hole
9, 29, and 69 Through-hole
11 Base Part Through-hole
15, 41, 51, 61, and 71 Comb Teeth

BEST MODE OF CARRYING OUT THE INVENTION

Figure 1:
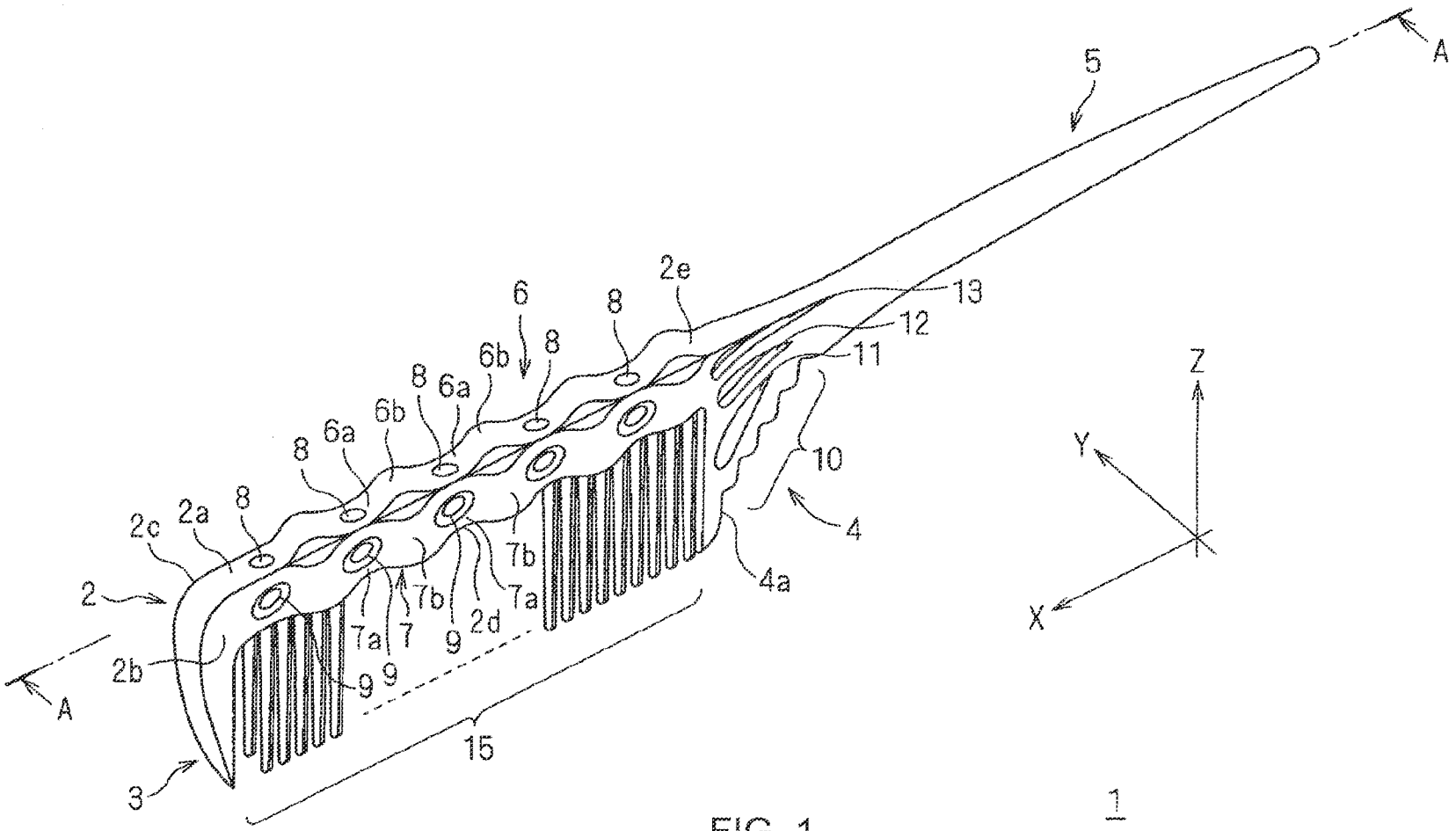
FIG. 1 is a perspective view of a comb according to an embodiment of the present invention.

FIG. 1 is a perspective view showing a comb 1 according to an embodiment of the present invention. The comb 1 of this embodiment is an integrally molded product made of a synthetic resin, and is a type of comb having a bar-shaped grip part 5 that protrudes to one side in the longitudinal direction. The comb 1 is characterized by having a comb main body 2 where two or more comb teeth 15 are formed in parallel, and having holes 8 and through-holes 9 that are formed in the comb main body 2, and having a concave-convex surface 6, a curving surface 7 and the like that are formed in surfaces of the comb main body 2. Hereinafter, the comb 1 according to a first embodiment is described in detail. The X-direction in FIG. 1 corresponds to the longitudinal direction of the comb 1 (the same direction as a longitudinal direction of the grip part 5), the Y-direction corresponds to a thickness direction of the comb 1 (a width direction of the comb 1 which is a direction perpendicular to the X-direction), and the Z-direction corresponds to a protruding direction of the comb teeth 15 (a direction perpendicular to the X-direction and the Y-direction). These X, Y, and Z-directions indicate the same directions as well in other figures.

Figure 2:
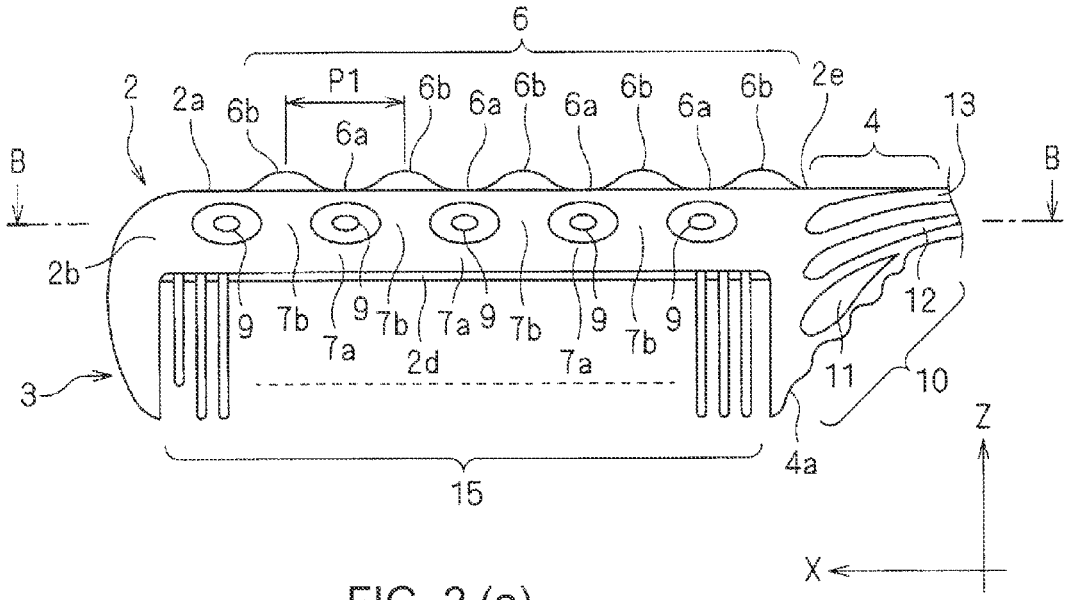
FIG. 2(*a*) is a substantial part enlarged view of substantial parts, such as a comb main body and comb teeth, viewed from the side, and FIG. 2(*b*) is a substantial part cross-sectional view taken along a line A-A in FIG. 1.
Figure 2:
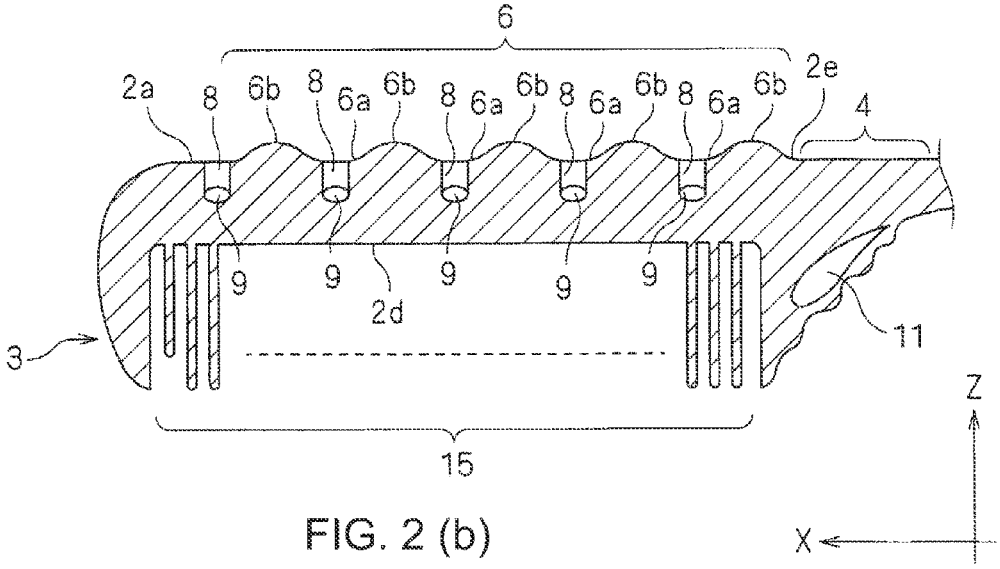

As shown in FIG. 1, FIGS. 2(*a*) and (*b*) and the like, the comb 1 is provided with a tip end protecting part 3 (a portion having a width which is thicker than the comb teeth 15) for protecting the comb teeth 15, toward a tip end side of the bar-shaped comb main body 2 so as to protrude in the same direction as the comb teeth 15. A base part 4 used as a protruding part of the grip part 5 is provided to one end side 2*e* of the grip part 5. In the illustrated direction shown in FIGS. 2(*a*) and (*b*), the base part 4 has a substantially triangular shape, and has a configuration where the grip part 5 protrudes from a location corresponding to a vertex of the triangle.

The comb main body 2 is formed with the concave-convex surface 6 in a back face part 2*a* (a face opposite from the side 2*d* where the comb teeth 15 are formed). The concave-convex surface 6 includes two or more concave parts 6*a* and convex parts 6*b*, and has a gently-sloping curved surface of the concave parts 6*a* and the convex parts 6*b* so as to conform to the curved surfaces of fingertips of a user. Intervals between peaks of the adjacent convex parts 6*b* are set so as to accommodate the user's fingertips in the concave parts 6*a* (in this embodiment, an interval P1 between the peaks of the adjacent convex parts 6*b* is set to about 10 mm). The comb main body 2 is formed with the holes 8 in every concave part 6*a* so that the holes 8 open from the respective concave parts 6*a*. The holes 8 are each formed so as to be an ellipse where an opening shape has the long axis in the X-direction, and a hole depth is set to a dimension so as to reach and communicate with the respective through-holes 9 described later (refer to FIG. 2(*b*)).

Figure 3:
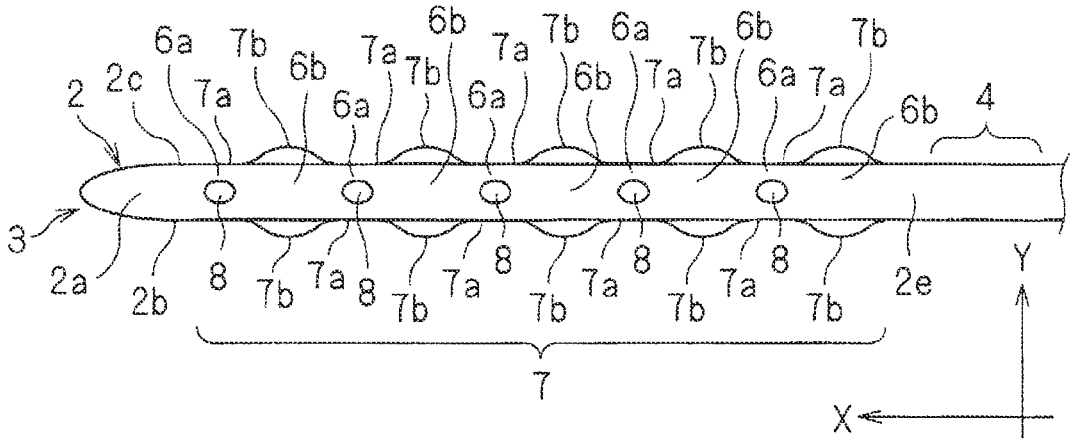
FIG. 3(*a*) is a substantial part enlarged view of substantial parts, such as the comb main body, viewed from the back, and FIG. 3(*b*) is a substantial part cross-sectional view taken along a line B-B in FIG. 2(*a*).
Figure 3:
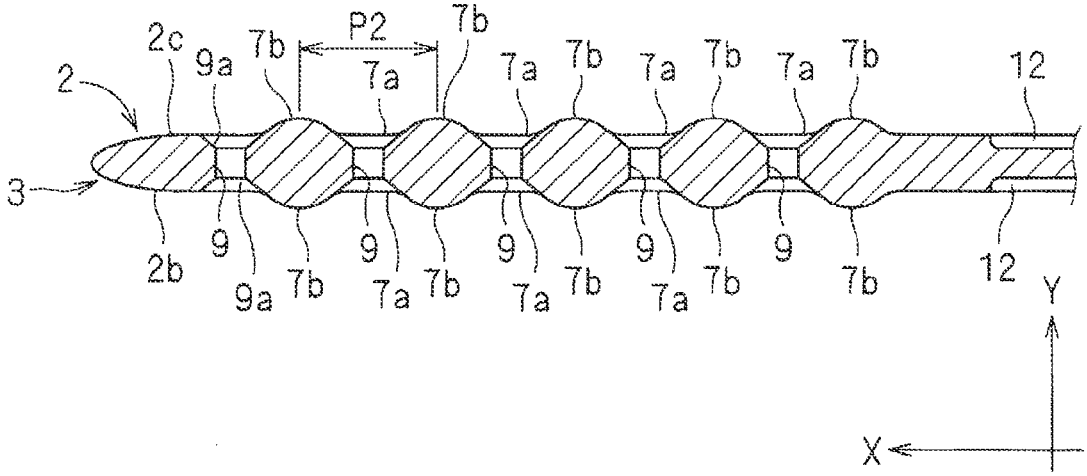

In addition, as shown in FIG. 1, FIGS. 3(*a*) and (*b*) and the like, in the comb main body 2, the curving surfaces 7 each having two or more concave parts 7*a* and convex parts 7*b* are formed in side face parts 2*b* and 2*c* on both sides in the thickness direction (Y-direction), respectively. In the curving surface 7, each of the two or more concave parts 7*a* is formed at the same position as each of the concave parts 6*a* of the back face part 2*a* in the X-direction, respectively, and the two or more convex parts 7*b* are formed at intervals so as to be located at the same positions as the convex parts 6*b* of the back face part 2*a* in the X-direction (for example, an interval P2 of the adjacent convex parts 7*b* is the same dimension as the interval P1 of the adjacent convex parts 6*b*). The curving surface 7 as well as the concave-convex surface 6 of the back face part 2*a* is formed to be a gently-sloping curved surface so as to guide the user's fingertips into the concave parts 7*a*.

In addition, the comb main body 2 is formed with the through-holes 9 penetrating the comb main body 2 in the thickness direction so that they open in the concave parts 7*a* of the side face parts 2*b* and 2*c* on both sides, respectively. The through-hole 9 has an ellipsoidal hole shape (the major axis direction of the ellipse is oriented in the X-direction), and is formed with an ellipsoidal counterbore part 9*a* (refer to FIG. 3(*b*)) in the opening parts of the side face parts 2*b* and 2*c*, respectively. As described above, the comb main body 2 is provided with two or more holes 8 and through-holes 9 to reduce its rigidity compared with the case where the holes 8 and the through-holes 9 are not formed. Further, the hole direction of the holes 8 are made different from the hole direction of the through-holes 9 (in terms of the depth direction of the holes) to allow the comb main body 2 to be deformed flexibly when external forces are applied from various directions. Note that the through-holes 9 communicate with the holes 8 of the back face part 2*a*, as described above.

The base part 4 formed on the end side 2*e* which is provided with the grip part 5 of the comb main body 2 is formed with a wave-shaped curve side part 10 in a lower side part 4*a* corresponding to the tip end side of the comb teeth 15, and is formed with a base part through-hole 11, a first groove part 12, and a second groove part 13 in the side face parts on the both sides, respectively (refer to FIG. 1, FIG. 2, etc.). The base part through-hole 11 has an elongated hole shape along a lower side part 4*a* of an oblique side, and is penetrated in the thickness direction of the comb main body 2. The first groove part 12 has a shape along the base part through-hole 11, and is formed so as to be elongated from base part through-hole 11 to the side where the grip part 5 is provided. Furthermore, the second groove part 13 has a shape along the first groove part 12, and is formed so as to be elongated more than the first groove part 12. Note that each of the grooves 12 and 13 does not penetrate the base part 4 in order to secure a strength required for the protruding grip part 5 while securing flexibility as much as possible. By the base part through-hole 11, the first groove part 12, and the second groove part 13, the base part 4 can deform flexibly, when an external force is received.

Among the two or more comb teeth 15 protruding from the comb main body 2, a protruding length of only one tooth adjacent to the tip end protecting part 3 is made shorter than others, and intervals of the comb teeth 15 are made shorter as it approaches the tip end protecting part 3 with respect to the base part 4. By configuring in this way, when the user uses the comb 1, hair to be styled can be appropriately raised also by the comb teeth 15 on the tip side.

Figure 4:
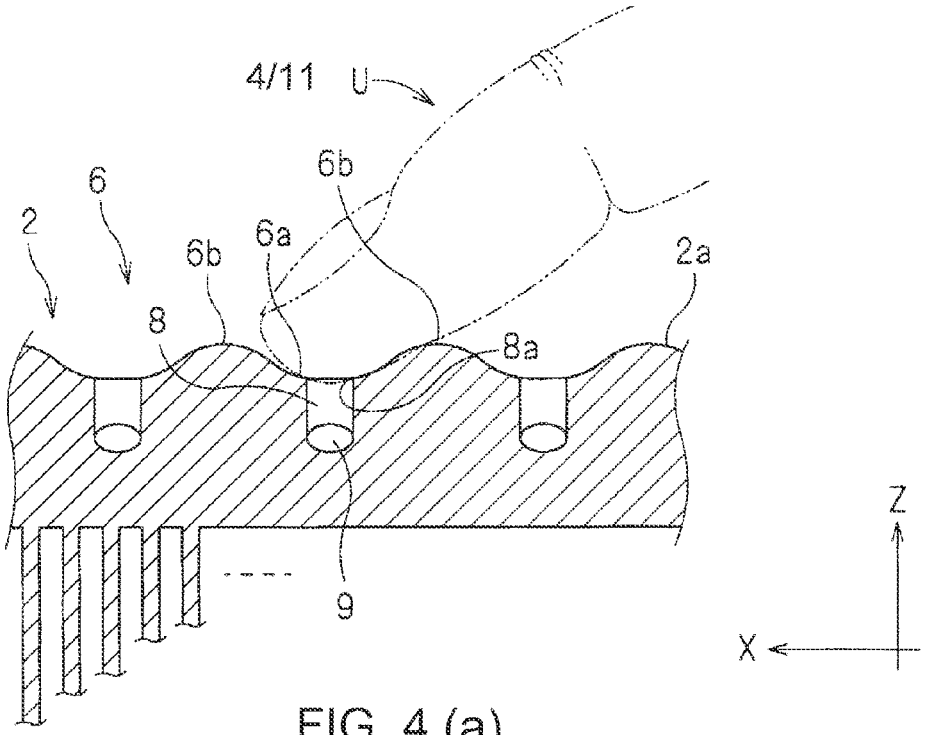
FIG. 4(*a*) is an enlarged cross-sectional view showing a state where a finger is applied to a back face part of the comb main body, and FIG. 4(*b*) is an enlarged cross-sectional view showing a state where a fingertip is wiped off by holes.
Figure 4:
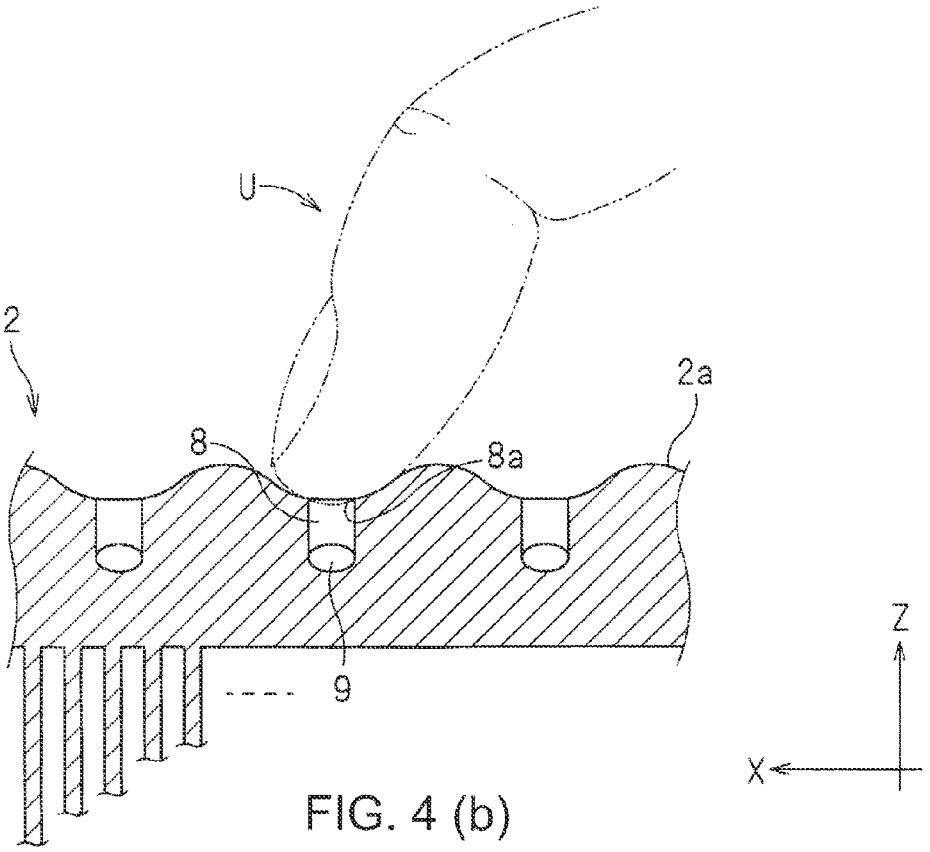
Figure 5:
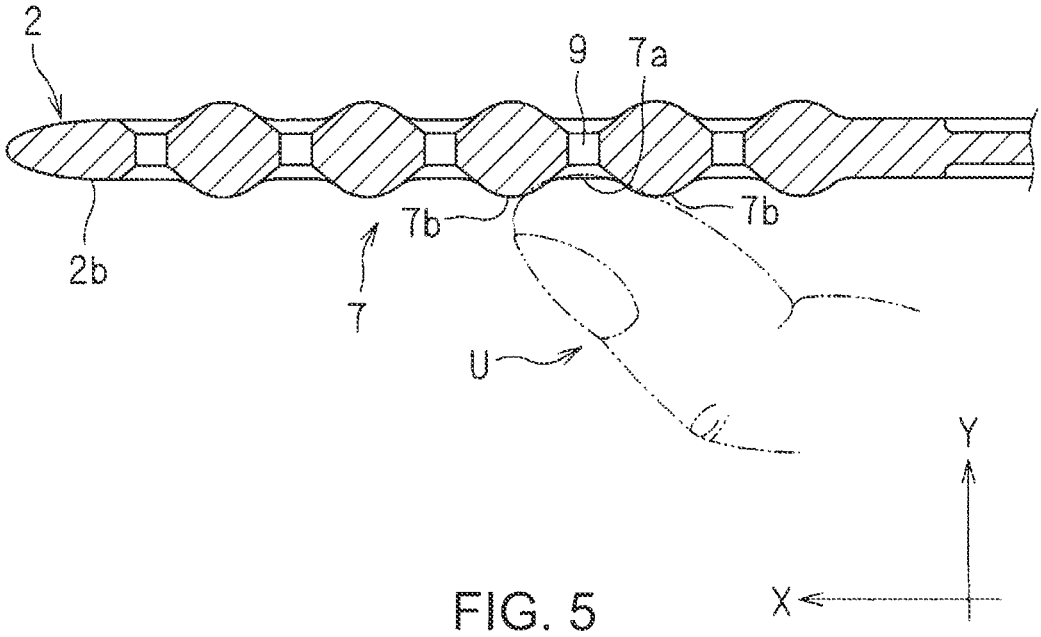
FIG. 5 is a substantial part cross-sectional view showing a state where a finger is applied to a side face part of the comb main body.
Figure 6:
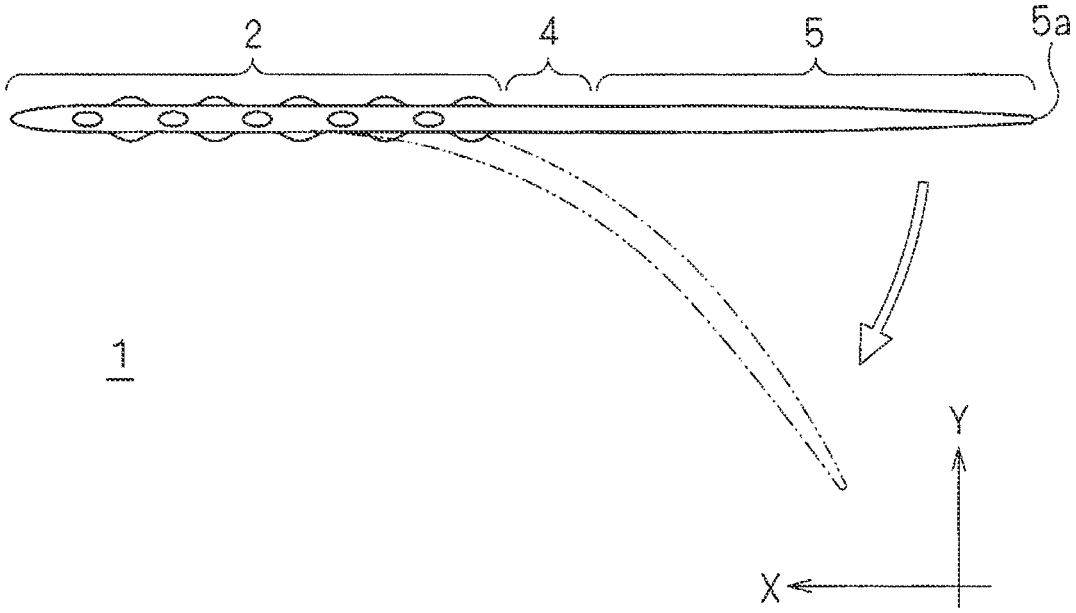
FIG. 6 is a schematic diagram showing a curved state of the comb.

Next, the use situation of the comb 1 of this embodiment by the user is specifically described using FIG. 4 to FIG. 6 and the like. First, as shown in FIG. 4(*a*), a case where the user uses the comb 1 applying his/her index finger U onto the back face part 2*a* of the comb main body 2 is described. When the user applies the index finger U to the back face part 2*a*, the index finger is guided to the oblique sides of two of the convex parts 6*b* located on both sides of one of the concave parts 6*a* in the concave-convex surface 6 to naturally locate the fingertip into the concave part 6*a*. Further, because the holes 8 open in the concave parts 6*a*, the fingertip of the index finger U located in the concave part 6*a* is caught by a hole edge 8*a* of the hole 8. Therefore, because the index finger U is gripped by the convex parts 6*b* on both sides of the concave part 6*a* and the fingertip is caught by the hole edge 8*a*, the comb 1 exhibits a good slippage preventing function to the index finger, compared with the conventional comb.

In the state shown in FIG. 4(*a*), the fingertip of the index finger U is located so as to block the hole 8, and the hole 8 communicates with the through-hole 9. Thus, because the fingertip of the index finger U touches with open air through the hole 8 and the through-hole 9, the fingertip gets dry easily even in a state where the index finger U which got wet by a liquid, such as a medical fluid or moisture, is applied to the back face part 2*a* of the comb main body 2, compared with the related art.

Further, if the user desires to positively remove the liquid adhered to the index finger U, as shown in FIG. 4(*a*) to FIG. 4(*b*), the user moves the index finger U so as to wipe the fingertip by the hole edge 8*a* of the hole 8, and the liquid is removed from the fingertip, flowing into the hole 8. Because the liquid flowed into the hole 8 can flow out to the outside from the through-hole 9 which communicates with the hole 8 when cleaning the comb 1, the liquid will not accumulate in the hole 8 and, thus, the hole 8 of the comb 1 can be kept clean.

On the other hand, as shown in FIG. 5, in a case of the user who grips the comb 1 by applying the finger U to the side face part of the comb main body 2 (for example, one side face part 2*b*), the user's fingertip is guided to the oblique sides of two of the convex parts 7*b* which are adjacent on the both sides to one of the concave parts 7*a* of the curving surface 7 to be naturally located in the concave part 7*a*. Because the through-hole 9 opens in the concave part 7*a*, the fingertip can be caught by the hole edge of the through-hole 9. For this reason, the finger U of the user is gripped by the convex parts 7*b* on both sides of the concave part 7*a* and the fingertip is caught by the through-hole 9, thereby the slippage preventing function is improved compared with the conventional comb also in the side face part of the comb main body 2.

Further, in the state shown in FIG. 5, because the user's finger is located so as to block the through-hole 9 and the user's finger U touches with open air through the through-hole 9, the fingertip can get dry easily even in the state where the finger U which got wet by the liquid, such as a medical fluid or moisture, is applied to the side face part 2*b* of the comb main body 2.

Further, as shown in FIG. 6, a case where an external force is applied to the comb 1 in the illustrated direction in the XY plane, for example, so that an end part 5*a* of the grip part 5 is curved in the clockwise direction is considered. In this case, because the rigidities of the comb main body 2 and the base part 4 are reduced by the holes 8, the through-holes 9, and the base part through-hole 11, the comb main body 2 and the base part 4 deform flexibly. For this reason, when the user curves the comb 1 conforming to a curvature of the head of the person whose hair is to be styled, the comb 1 of this embodiment is easy to curve, compared with the conventional comb. In addition, in the comb 1, because the hole directions of the holes 8 and the through-holes 9 are different from each other, the comb 1 is easy to curve flexibly also in directions other than the illustrated direction in the XY plane, and, therefore, the comb 1 (the comb main body 2 or the base part 4) can be freely curved in a direction which the user feels easy to use.

Note that the configuration according to the present invention is not limited to the comb 1 according to the embodiment described above, and, of course, it may be applied to other types of combs, and various modifications may also be considered. For example, in the comb 1 shown in FIG. 1 and the like, the grip part 5 may be integrally formed with the comb main body 2, the base part 4 and the like. A metal bar-shaped material may be used as the grip part 5, and the bar-shaped material is insert-molded (outsert-molded) into the comb main body 2, the base part 4 and the like made of a synthetic resin material to form the comb according to the present invention (such a grip part of metal bar-shaped material may also be applied to the types of various modifications having a grip part described later (types shown in FIG. 8 to FIG. 11, etc.).

Figure 7:
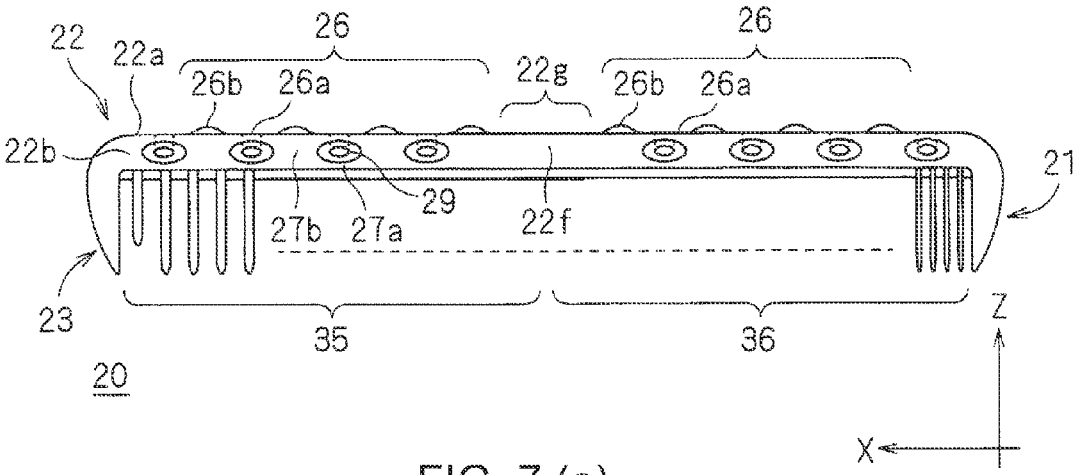
FIGS. 7(*a*) and (*b*) show a comb according to another embodiment of the present invention, where FIG. 7(*a*) is an outline view from the side, and FIG. 7(*b*) is an outline view from the back.
Figure 7:
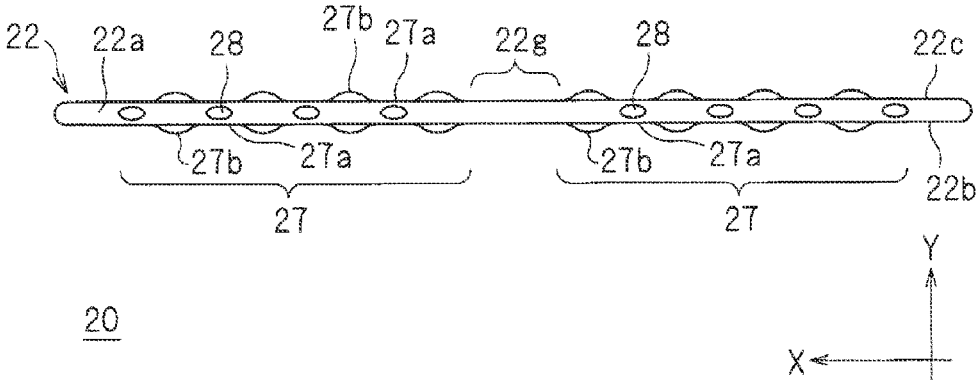

FIGS. 7(*a*) and (*b*) show a case where the configuration according to the present invention is applied to a type of comb 20 without the projecting grip part being provided. In this comb 20, a first protecting part 23 (equivalent to the tip end protecting part 3 of FIG. 1 and the like) protrudes on one side of an elongated comb main body 22, and a second protecting part 21 (has a symmetrical shape to the first protecting part 23) protrudes from the other side. Further, in the comb 20, two or more first comb teeth 35 which are relatively thicker protrude in parallel within a range from a center position 22*f* of the comb main body 22 in the longitudinal direction to the first protecting part 23. On the other hand, a range from the center position 22*f* to the second protecting part 21, two or more second comb teeth 36 which are relatively thinner compared with the first comb teeth 35 protrude in parallel narrower than the intervals of the respective first comb teeth 35.

In the comb 20, a concave-convex surface 26 having two or more concave parts 26*a* and convex parts 26*b*, similar to the comb 1 shown in FIG. 1 and the like, are formed in the back face part 22*a* of the comb main body 22, in a range excluding a central range part 22*g* corresponding to the center position 22*f*, and holes 28 are formed so as to open in the concave parts 26*a*, respectively. Further, in the comb 20, a curving surface 27 having two or more concave parts 27*a* and convex parts 27*b*, similar to the comb 1, are formed in side face parts 22*b* and 22*c* on both sides of the comb main body 22, respectively, in a range excluding the central range part 22*g*, and through-holes 29 are formed so as to open in the concave parts 27*a*, respectively.

The comb 20 of such a configuration is also improved in the slippage preventing function similar to the comb 1 described above, and by this comb 20, the liquid adhered to the user's fingertips can be removed appropriately. Further, it is possible to curve the comb main body 22 flexibly according to the user's use situation. In the comb 20, the central range part 22*g* is formed in a flat surface without providing the concave-convex surface 26 of the back face part 22*a* and the curving surfaces 27 of the side face parts 22*b* and 22*c* in the central range part 22*g*. Thus, when changing between the gripping way where the first comb teeth 35 are used mainly and the gripping way where the second comb teeth 36 are used mainly, the user may easily change the ways of gripping the comb 20 in the central range part 22*g*.

Figure 8:
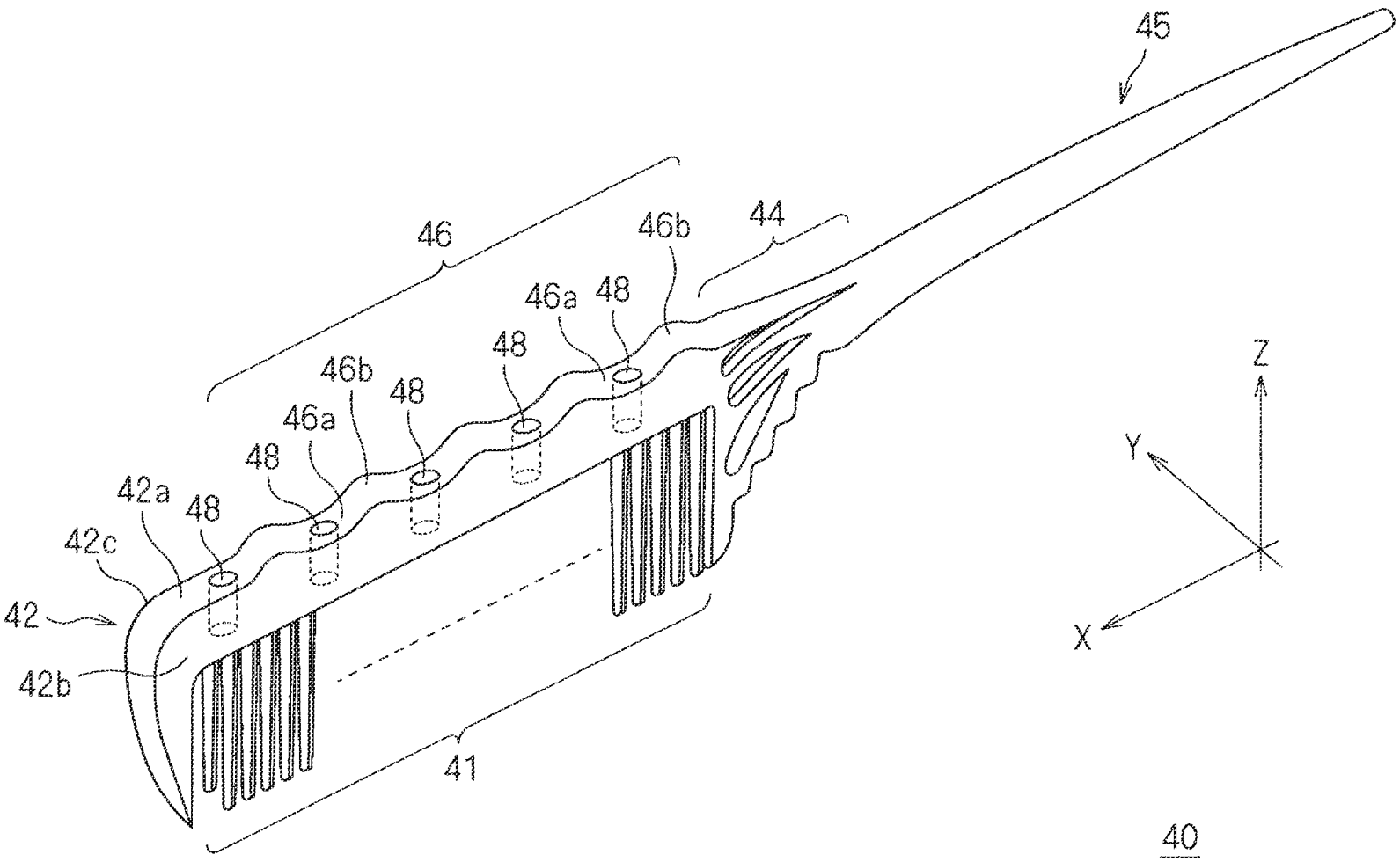
FIG. 8 is a perspective view of a comb according to a modification of the present invention.

A comb 40 of FIG. 8 indicates a modification of the comb 1 shown in FIG. 1 and the like. The comb 40 is, similar to the comb 1, a type of comb where a bar-shaped grip part 45 projects from a base part 44 provided to a comb main body 42 where two or more comb teeth 41 protrude in parallel. Concave-convex surface 46 having two or more concave parts 46*a* and convex parts 46*b* is formed in a back face part 42*a*, and holes 48 are formed so as to open in the concave parts 46*a* (a curving surface is not formed in side face parts 42*b* and 42*c*). This comb 40 is a suitable model for the user who applies the index finger to the back face part 42*a* to use, where the user's fingers are guided onto the concave parts 46*a* by two adjacent convex parts 46*b* of the concave-convex surface 46, and by the convex parts 46*b* and the holes 48 of the concave parts 46*a*, it exhibits an outstanding grip function, while enabling the user to wipe the fingertips by the holes 48.

As another modification to consider based on the comb 40 of FIG. 8, only two or more through-holes penetrating the comb main body 42 in the width direction may be formed in the side face parts 42*b* and 42*c* of the comb main body 42. In addition, these through-holes may communicate with the holes 48. As still another modification, forming only a curving surface (refer to the curving surface 7 shown in FIG. 1, FIG. 3, etc.) in at least one of the side face parts 42*b* and 42*c* of the comb main body 42 instead may also be considered (when forming a curving surface in the comb 40 of FIG. 8, the through-holes will not be provided).

Figure 9:
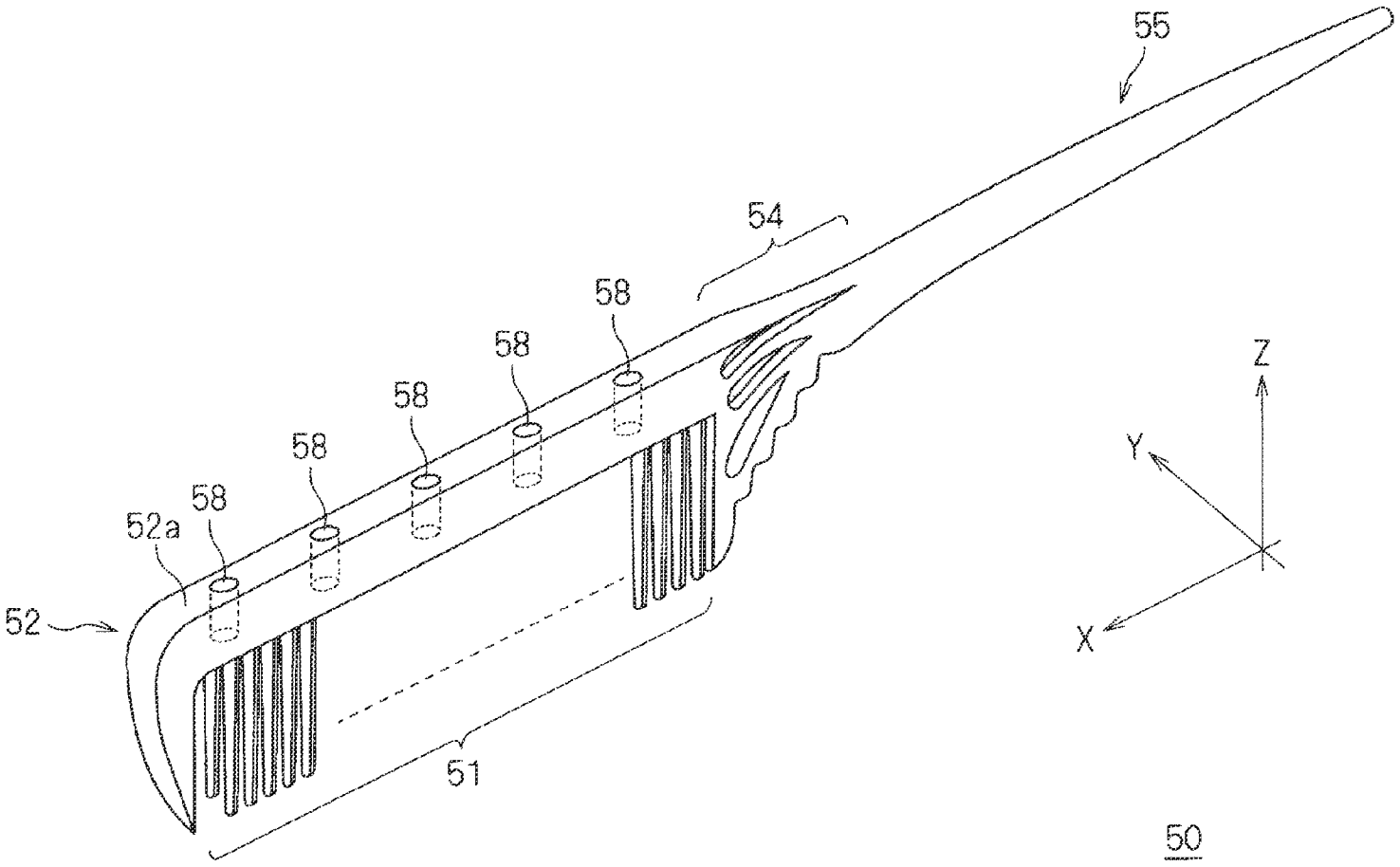
FIG. 9 is a perspective view of a comb according to another modification of the present invention.

Further, a comb 50 of FIG. 9 indicates another modification of the comb 1 shown in FIG. 1 and the like, and this configuration is further simplified than the comb 40 of FIG. 8. Specifically, the comb 50 has a grip part 55 projecting from a base part 54 provided to the comb main body 52 from which comb teeth 51 protrude, and two or more holes 58 are formed in a back face part 52*a* so as to be spaced by a predetermined interval (for example, about 10 mm pitch). In the comb 50 of this modification, a concave-convex surface is not formed in the back face part 52*a*, and curving surfaces are not formed in the side face parts on both sides. However, because it is possible to catch the fingertip of the user's index finger by the respective holes 58 of the back face part 52*a*, the slippage preventing function can be implemented with a simple configuration, and the liquid adhered to the fingertip can also be removed by wiping the fingertip by the respective holes 58.

As another modification based on the comb 50 of FIG. 9, similar to the comb 40 of FIG. 8 described above, only two or more through-holes may be formed in the side face parts of the comb main body 52 (each through-hole may also communicate with the hole 58), or only a curving surface may be formed in at least one of the side face parts of the comb main body 52 (when forming the curving surface, the through-holes may not be formed).

Figure 10:
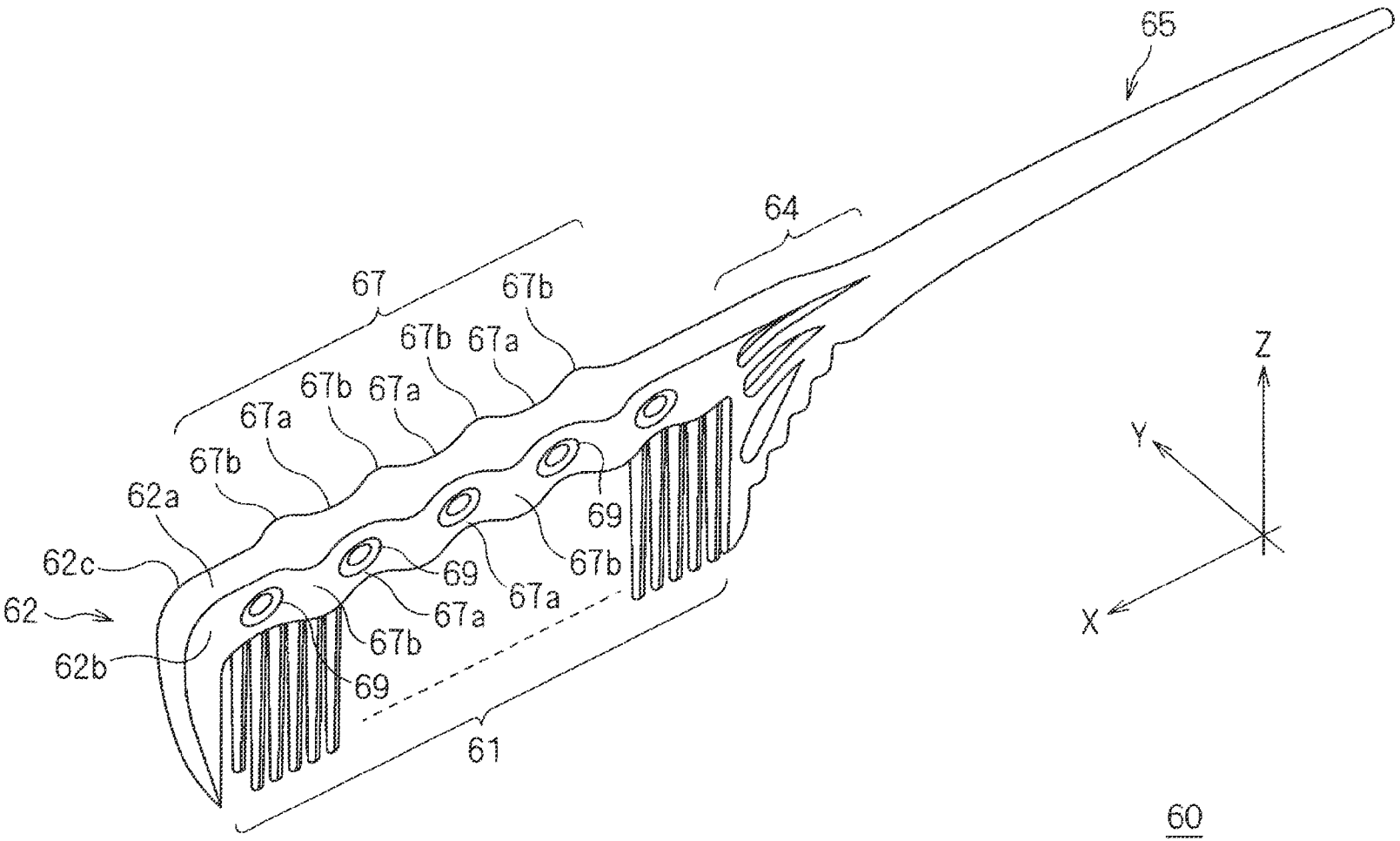
FIG. 10 is a perspective view of a comb according to still another modification of the present invention.

Further, a comb 60 of FIG. 10 indicates another modification of the comb 1 shown in FIG. 1 and the like. The comb 60 of this modification has a grip part 65 projecting from a base part 64 provided to a comb main body 62 from which comb teeth 61 protrude, a curving surface 67 having two or more concave parts 67*a* and convex parts 67*b* and formed in side face parts 62*b* and 62*c* on both sides of the comb main body 62, and through-holes 69 formed so as to open in concave parts 67*a*. Note that the comb 60 is not formed with both the holes and the concave-convex surface in a back face part 62*a*.

Such a comb 60 is a suitable model for a type of user who applies his/her fingers onto the side face part 62*b* (or the side face part 62*c*) of the comb main body 62 to grip the comb. In the comb 60, two adjacent convex parts 67*b* of the curving surface 67 guide the user's fingers to the concave part 67*a* located between them, an outstanding grip function is exhibited by the convex parts 67*b* and through-hole 69 of the concave part 67*a*, and the through-hole 69 allows the fingertip to be exposed to the open air even in the gripping state. The curving surface 67 of the comb 60 may also be provided, other than being provided to the side face parts 62*b* and 62*c* on both sides, to only one of the side face parts (only the side face part 62*b* or the side face part 62*c*) (the same can be applied to the comb 1 of FIG. 1 and the like and the comb 20 of FIGS. 7(*a*) and (*b*)). Further, as another modification based on the comb 60 of FIG. 10, only a concave-convex surface (refer to the concave-convex surface 6 of FIG. 1, FIG. 2, etc.) may be formed in the back face part 62*a* of the comb main body 62 or the like instead, and in such a case where only the concave-convex surface is formed, the through-holes 69 may be omitted.

Figure 11:
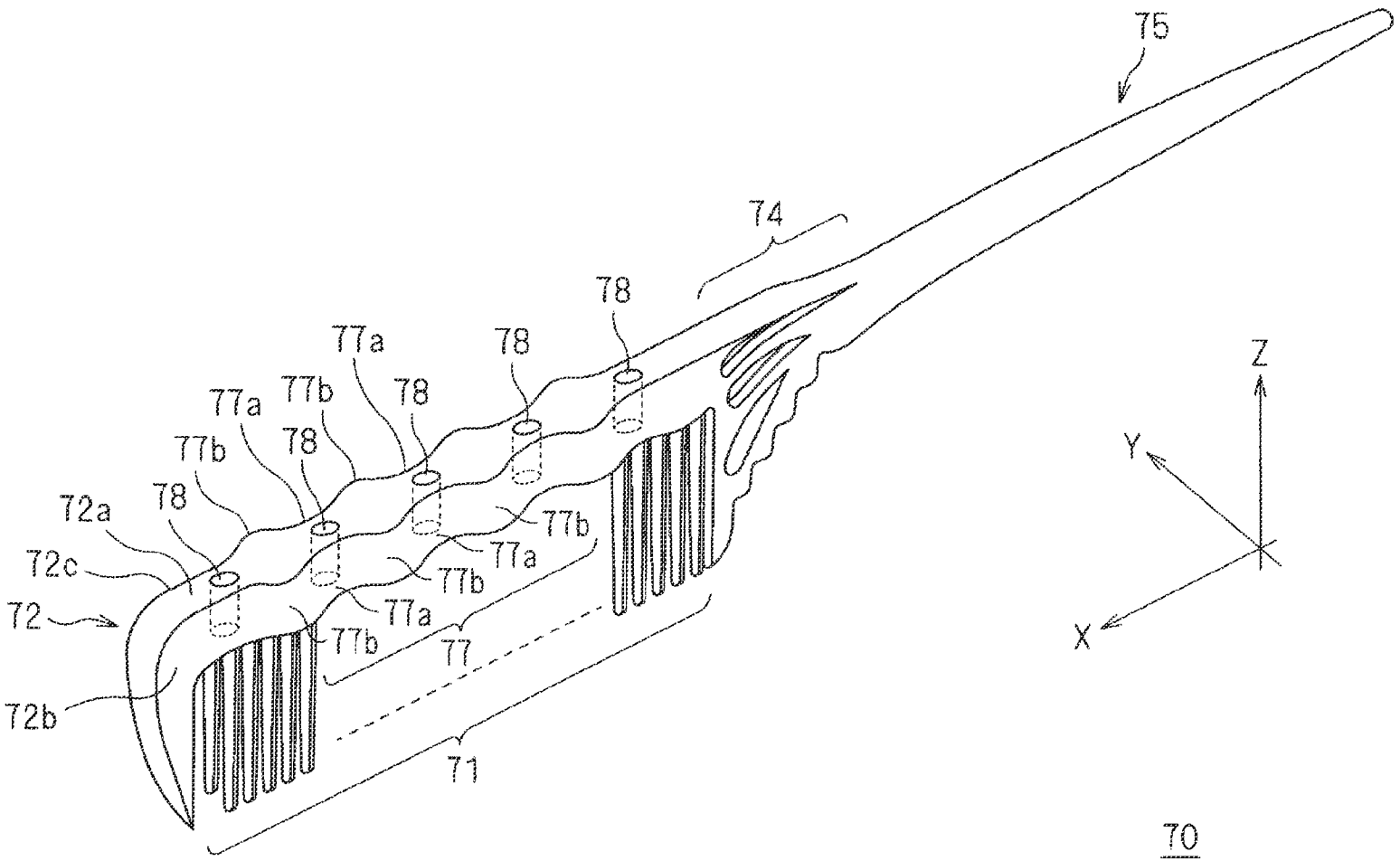
FIG. 11 is a perspective view of a comb according to another modification of the present invention.

Further, a comb 70 of FIG. 11 indicates still another modification of the comb 1 shown in FIG. 1 and the like, and the comb 70 of this modification has a configuration in which the concave-convex surface 6 in the back face part 2*a* and the through-holes 9 in the side face parts 2*a* and 2*c* are omitted from the comb 1 shown in FIG. 1 and the like. That is, the comb 70 has a grip part 75 projecting from a base part 74 provided to a comb main body 72 from which comb teeth 71 protrude, curving surfaces 77 having two or more concave parts 77*a* and convex parts 77*b* formed in side face parts 72*b* and 72*c* on both sides of the comb main body 72, and two or more holes 78 formed in a back face part 72*a* of the comb main body 72. Even with such a simple configuration, the slippage preventing function can be exhibited in the back face part 72*a* by the holes 78, and the slippage preventing function can be exhibited in the side face parts 72*a* and 72*b* by the curving surfaces 77. Of course, the through-holes may be formed in the concave parts 77*a* of the curving surface 77 also in the comb 70 of FIG. 11.

Of course, the configurations according to the various modifications shown in FIG. 8 to FIG. 11 described above may also be applied to the type of comb shown in FIGS. 7(*a*) and (*b*) (the type where the grip part does not protrude).

INDUSTRIAL APPLICABILITY

By forming holes and concave-convex surfaces in respective parts of a comb main body, a slippage preventing function and a function for removing a liquid adhered to fingertips of a user are further improved, and, moreover, the rigidity of the comb main body is reduced to make it easy to curve flexibly, thereby increasing an efficiency of work related to hair styling in a hair styling field, a cosmetics field and the like.

What is claimed is:

1. A comb comprising a comb main body, two or more comb teeth provided to the comb main body, and two or more through-holes penetrating the comb main body in a thickness direction of the comb main body;

wherein curving surfaces having two or more concave and convex parts are formed in both side face parts of the comb main body, the side face parts extending in a direction perpendicular to a thickness direction of the comb main body;

wherein each of the concave parts in one side face part is formed at a same position as each of concave parts in an opposite side face part in a longitudinal direction of the comb main body;

wherein each of the convex parts in one side face part is formed at a same position as each of the convex parts in the opposite side face part in the longitudinal direction of the comb main body;

wherein each end of each of the through-holes opens in a respective one of the concave parts, which are formed between the convex parts on the curving surfaces;

wherein each of the convex parts forms a curving line of an outline of a cross-section that is cut along a cutting plane that extends in the longitudinal direction and in the thickness direction through the through-holes and through the convex parts.

2. The comb according to claim 1, wherein a base part from which a bar-shaped grip part protrudes is formed in the comb main body;

wherein a base part through-hole penetrating the base part in the thickness direction of the comb main body is formed and the base part through-hole has an elongated hole shape;

wherein one or more groove parts are formed along the base part through-hole in the base part.

3. The comb according to claim 1, wherein a concave-convex surface having two or more concave and convex parts is formed in a back face part of the comb main body, the back face part being opposite from where the two or more comb teeth are provided.

4. The comb according to claim 2, wherein a concave-convex surface having two or more concave and convex parts is formed in a back face part of the comb main body, the back face part being opposite from where the comb teeth are provided.

5. The comb according to claim 3, wherein each of concave parts of the concave-convex surface is formed at a same position as each of concave parts of the curving surfaces in a longitudinal direction of the comb main body;

wherein each of convex parts of the concave-convex surface is formed at a same position as each of convex parts of the curving surfaces in the longitudinal direction of the comb main body.

6. The comb according to claim 4, wherein each of concave parts of the concave-convex surface is formed at a same position as each of concave parts of the curving surfaces in the longitudinal direction of the comb main body;

wherein each of convex parts of the concave-convex surface is formed at a same position as each of convex parts of the curving surfaces in the longitudinal direction of the comb main body.

7. The comb according to claim 1, wherein two or more holes are formed in a back face part of the comb main body, the back face part being opposite from where the comb teeth are provided.

8. The comb according to claim 2, wherein two or more holes are formed in a back face part of the comb main body, the back face part being opposite from where the two or more comb teeth are provided.

9. The comb according to claim 3, wherein two or more holes are formed in the back face part of the comb main body, and each of the holes opens in each of the concave parts of the concave-convex surface.

10. The comb according to claim 4, wherein two or more holes are formed in the back face part of the comb main body, and each of the holes opens in each of the concave parts of the concave-convex surface.

11. The comb according to claim 5, wherein two or more holes are formed in the back face part of the comb main body, and each of the holes opens in each of the concave parts of the concave-convex surface;

wherein the holes and the through-holes communicate with each other.

12. The comb according to claim 6, wherein two or more holes are formed in the back face part of the comb main body, and each of the holes opens in each of the concave parts of the concave-convex surface;

wherein the holes and the through-holes communicate with each other.

* * * * *